US011047061B2

(12) United States Patent
Sung et al.

(10) Patent No.: US 11,047,061 B2
(45) **Date of Patent: *Jun. 29, 2021**

(54) MICRO-ROUGHENED ELECTRODEPOSITED COPPER FOIL AND COPPER FOIL SUBSTRATE

(71) Applicant: CO-TECH DEVELOPMENT CORP., Taipei (TW)

(72) Inventors: Yun-Hsing Sung, Taoyuan (TW); Chun-Yu Kao, Yunlin County (TW); Zong-Xian Wu, Yunlin County (TW)

(73) Assignee: CO-TECH DEVELOPMENT CORP., Taipei (TW)

( * ) Notice: Subject to any disclaimer, the term of this patent is extended or adjusted under 35 U.S.C. 154(b) by 71 days.

This patent is subject to a terminal disclaimer.

(21) Appl. No.: 16/563,958

(22) Filed: Sep. 9, 2019

(65) Prior Publication Data

US 2020/0095701 A1 Mar. 26, 2020

(30) Foreign Application Priority Data

Sep. 26, 2018 (TW) ..... 107133827

(51) Int. Cl.
*B21C 37/00* (2006.01)
*C25D 5/16* (2006.01)
(Continued)

(52) U.S. Cl.
CPC ..... *C25D 5/16* (2013.01); *C25D 1/04* (2013.01); *C25D 3/38* (2013.01); *Y10T 428/12431* (2015.01)

(58) Field of Classification Search
None
See application file for complete search history.

(56) References Cited

U.S. PATENT DOCUMENTS 6,291,081 B1 * 9/2001 Kurabe ..... C25D 1/04 174/257
2005/0175826 A1 * 8/2005 Suzuki ..... C25D 1/04 428/209

(Continued)

FOREIGN PATENT DOCUMENTS

JP 2008285751 A 11/2008
JP 2009218206 A 9/2009

(Continued)

OTHER PUBLICATIONS

Merriam-Webster, "Definition of length", https://www.merriam-webster.com/dictionary/length, accessed May 6, 2020 (Year: 2020).*

*Primary Examiner* — Seth Dumbris
(74) *Attorney, Agent, or Firm* — Li & Cai Intellectual Property Office

(57) ABSTRACT

A micro-roughened electrodeposited copper foil and a copper foil substrate are provided. The micro-roughened electrodeposited copper foil includes a micro-rough surface. The micro-rough surface has a plurality of peaks, a plurality of grooves and a plurality of micro-crystal clusters. Each of the grooves has a U-shaped or V-shaped cross-section profile, and the grooves have an average maximum width between 0.1 μm and 4 μm and an average depth less than or equal to 1.5 μm. Each of the micro-crystal clusters is composed of a plurality of micro-crystals each having an average diameter less than or equal to 0.5 μm grouped together. The micro-rough surface of the micro-roughened electrodeposited copper foil has an Rlr value less than 1.3. The micro-rough surface has good bonding strength relative to a substrate, and the copper foil substrate has good insertion loss performance to significantly reduce signal loss.

12 Claims, 7 Drawing Sheets

(51) Int. Cl.
*C25D 3/38* (2006.01)
*C25D 1/04* (2006.01)

(56) References Cited

U.S. PATENT DOCUMENTS

| | | | | |
|---|---|---|---|---|
| 2009/0047539 | A1* | 2/2009 | Dobashi | C25D 1/04<br>428/607 |
| 2012/0189859 | A1* | 7/2012 | Nozaki | H05K 1/09<br>428/458 |

FOREIGN PATENT DOCUMENTS

| | | | |
|---|---|---|---|
| JP | 2018141228 | A | 9/2018 |
| WO | WO2016174998 | A1 | 11/2016 |
| WO | WO2017006739 | A1 | 1/2017 |
| WO | WO2017138338 | A1 | 8/2017 |

* cited by examiner

MICRO-ROUGHENED ELECTRODEPOSITED COPPER FOIL AND COPPER FOIL SUBSTRATE

CROSS-REFERENCE TO RELATED PATENT APPLICATION

This application claims the benefit of priority to Taiwan Patent Application No. 107133827, filed on Sep. 26, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a copper foil, and more particularly to an electrodeposited copper foil and a copper foil substrate having the electrodeposited copper foil.

BACKGROUND OF THE DISCLOSURE

With the development of information and electronic industries, high-frequency and high-speed signal transmission has become an integral part of modern circuit design and manufacture. In order to meet the high-frequency and high-speed signal transmission requirements of electronic products, the copper foil substrate used needs to have a good insertion loss performance at high frequencies so as to transmit high-frequency signals without excessive loss. The insertion loss of the copper foil substrate is highly correlated with its surface roughness. The copper foil substrate has a good insertion loss performance when the surface roughness is decreased, or otherwise does not. However, the decrease of the surface roughness may reduce the peel strength between the copper foil and the substrate. Therefore, how the peel strength can be maintained at the industry level and provide good insertion loss performance has become a problem to be solved in the related industry.

SUMMARY OF THE DISCLOSURE

In response to the above-referenced technical inadequacies, the present disclosure provides a micro-roughened electrodeposited copper foil.

In one aspect, the present disclosure provides a micro-roughened electrodeposited copper foil. The micro-roughened electrodeposited copper foil includes a micro-rough surface that has a plurality of peaks, a plurality of grooves and a plurality of micro-crystal clusters. Each of the grooves has a U-shaped or V-shaped cross-section profile, and has an average maximum width between 0.1 μm and 4 μm and an average depth less than or equal to 1.5 μm. The micro-crystal clusters are correspondingly located on the tops of the peaks and each thereof is composed of a plurality of micro-crystals each having an average diameter less than or equal to 0.5 μm grouped together. The micro-rough surface of the micro-roughened electrodeposited copper foil has an Rlr value less than 1.3.

In certain embodiments, each of the micro-crystals has an average height less than or equal to 2 μm.

In certain embodiments, the average height of each of the micro-crystals is less than or equal to 1.3 μm. A number of the micro-crystal clusters form into a branch-shaped crystal group.

In certain embodiments, the Rlr value the micro-rough surface of the micro-roughened electrodeposited copper foil is less than 1.26.

In one aspect, the present disclosure provides a copper foil substrate which includes a substrate and a micro-roughened electrodeposited copper foil. The micro-roughened electrodeposited copper foil includes a micro-rough surface attached to the substrate. The micro-rough surface is formed with a plurality of peaks, a plurality of grooves and a plurality of micro-crystal clusters. Each of the grooves has a U-shaped or V-shaped cross-section profile, and has an average maximum width between 0.1 μm and 4 μm and an average depth less than or equal to 1.5 μm. The micro-crystal clusters are correspondingly located on the tops of the peaks and each thereof has an average height less than or equal to 2 μm. The copper foil substrate has an insertion loss between 0 and −1.5 dB/in at 20 GHz. The micro-roughened electrodeposited copper foil has a peel strength greater than 4.3 lb/in relative to the substrate.

In certain embodiments, the copper foil substrate has an insertion loss between 0 and −1.2 dB/in at 16 GHz.

In certain embodiments, the copper foil substrate has an insertion loss between 0 and −0.65 dB/in at 8 GHz and an insertion loss between 0 and −1.0 dB/in at 12.89 GHz.

In certain embodiments, the insertion loss of the copper foil substrate at 8 GHz is between 0 and −0.63 dB/in. The insertion loss of the copper foil substrate at 12.89 GHz is between 0 and −0.97 dB/in. The insertion loss of the copper foil substrate at 16 GHz is between 0 and −1.15 dB/in. The insertion loss of the copper foil substrate at 20 GHz is between 0 and −1.45 dB/in.

In certain embodiments, the average maximum width of each of the micro-crystal clusters is less than or equal to 5 μm. A portion of the micro-crystal clusters are formed with a branch-shaped crystal group. The average height of the micro-crystal clusters is less than or equal to 1.8 μm. Each of the micro-crystal clusters is composed of a plurality of micro-crystals grouped together, and each of the micro-crystals has an average diameter less than or equal to 0.5 μm. The micro-rough surface of the micro-roughened electrodeposited copper foil has an Rlr value less than 1.26.

In certain embodiments, the substrate has a dielectric constant (Dk) less than 4.0 and a dissipation factor (Df) less than 0.020 at 10 GHz. Preferably, the substrate has a Dk less than 3.8 and a Df less than 0.015.

One of the advantages of the present disclosure is that the micro-rough surface has good bonding strength relative to the substrate, and the copper foil substrate has good insertion loss performance and can significantly reduce the transmission loss of signals.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
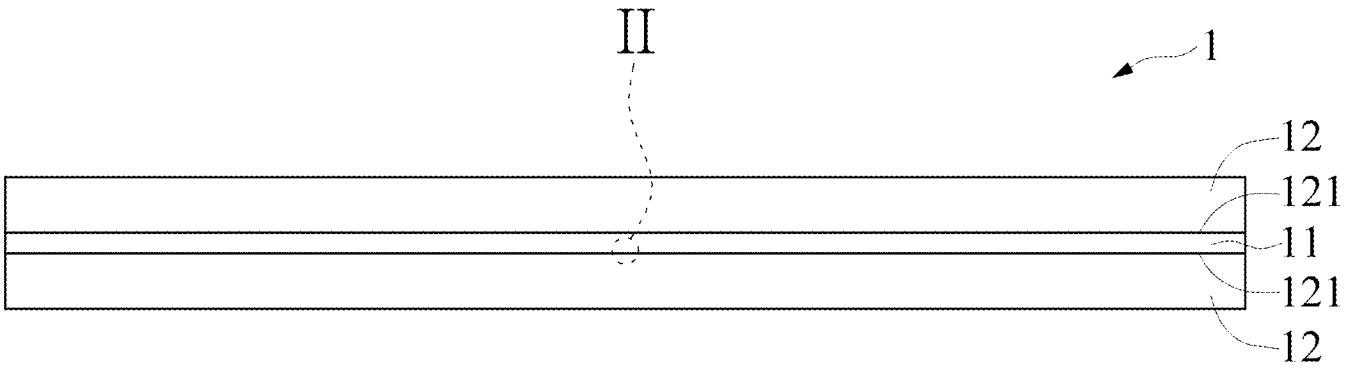
FIG. 1 is a side schematic view showing one configuration of a copper foil substrate of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1, a copper foil substrate 1 of the present disclosure includes a substrate 11 and two micro-roughened electrodeposited copper foils 12. The micro-roughened electrodeposited copper foils 12 are respectively attached to two opposite sides of the substrate. It is worth mentioning that, the copper foil substrate 1 can include only one micro-roughened electrodeposited copper foil 12.

The substrate 11 has a low dielectric constant (Dk) and a low dissipation factor (Df) so as to reduce insertion loss. Preferably, the substrate 11 has a Dk less than 4 and a Df less than 0.020. More preferably, the substrate 11 has a Dk less than 3.8 and a Df less than 0.015.

The substrate 11 can be made from a composite material which is prepared by impregnating a base material with a synthetic resin. The base material may, for example, be a phenolic cotton paper, cotton paper, resin fiber fabric, resin fiber non-woven fabric, glass board, glass woven fabric, or glass non-woven fabric. The synthetic resin may, for example, be an epoxy resin, polyester resin, polyimide resin, cyanate ester resin, bismaleimide triazine resin, polyphenylene ether resin, or phenol resin. The synthetic resin layer may be formed into a single layer or multi layers, but is not limited thereto. The substrate 11 may be made from, but not limited to, EM891, IT958G, IT150DA, S7439G, MEGTRON 4, MEGTRON 6, or MEGTRON 7.

Figure 2:
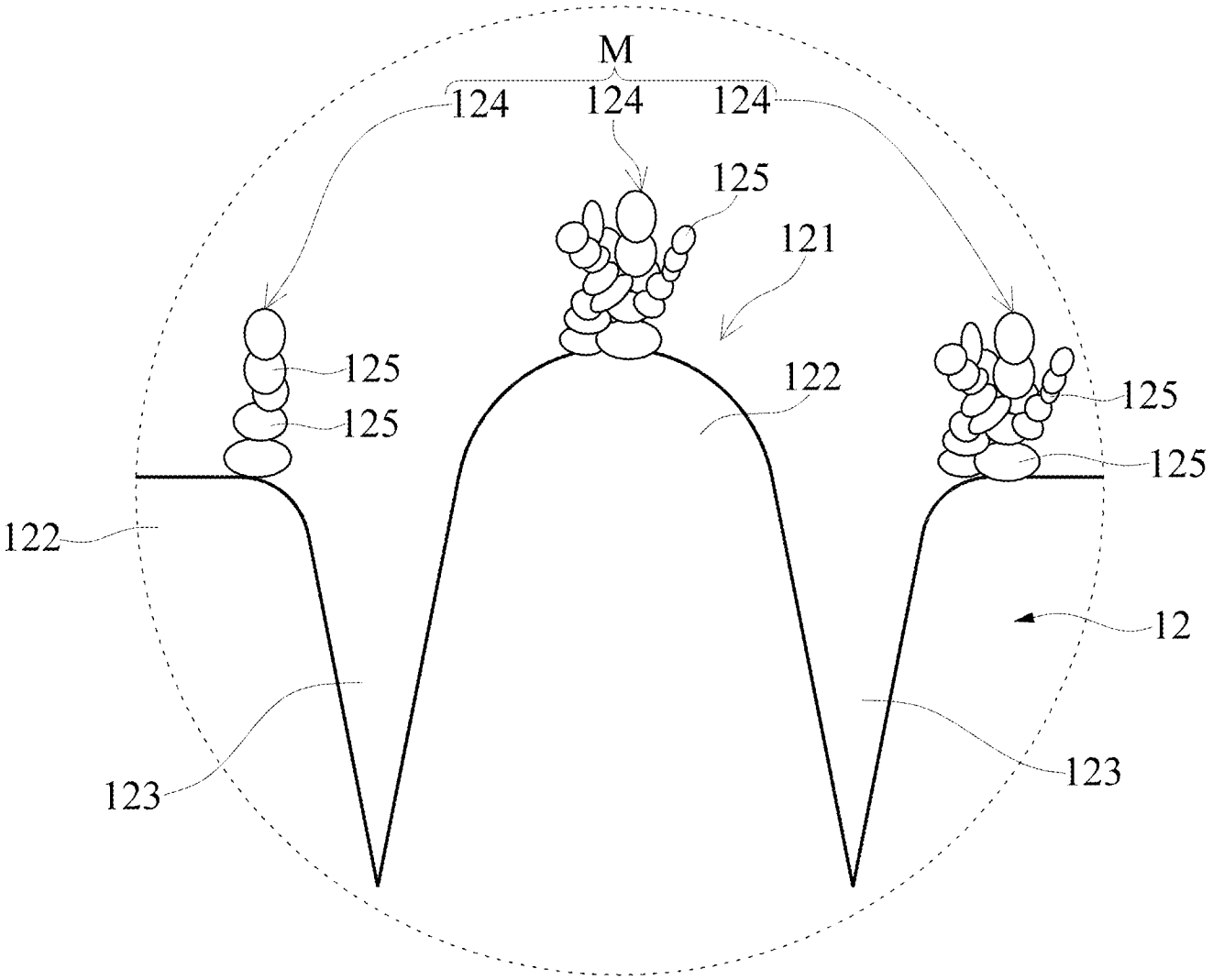
FIG. 2 is an enlarged view of part II of FIG. 1.

Referring to FIG. 1 along with FIG. 2, the micro-roughened electrodeposited copper foil 12 is obtained by using an electrolysis method to roughen a surface of a copper foil. The electrolysis method can be used to roughen any one of the surfaces of the copper foil, such that the micro-roughened electrodeposited copper foil 12 has a micro-rough surface 121 on at least one side thereof. In one embodiment of the present disclosure, a very low profile (VLP) copper foil is used as a raw foil and subsequently a rough surface thereof is roughened to obtain the micro-roughened electrodeposited copper foil 12.

The micro-rough surface 121 is configured to attach to the substrate 11, and includes a plurality of peaks 122, a plurality of grooves 123 and a plurality of micro-crystal clusters 124. The groove 123 has a U-shaped or V-shaped cross-section profile. The groove 123 has an average depth less than or equal to 1.5 μm, preferably less than or equal to 1.3 μm, and more preferably less than or equal to 1 μm. The groove 123 has an average maximum width between 0.1 μm and 4 μm.

The micro-crystal cluster 124 has an average height less than 2 μm, preferably less than 1.8 μm, and more preferably less than 1.6 μm. The aforesaid "average height" refers to a distance from the top of the micro-crystal cluster 124 to the top of the corresponding peak 122. The micro-crystal cluster 124 has an average maximum width less than 5 μm, preferably less than 3 μm. Each of the micro-crystal clusters 124 is composed of a plurality of micro-crystals 125 grouped together. The micro-crystal 125 has an average diameter less than or equal to 0.5 μm, preferably between 0.05 μm to 0.5 μm, and more preferably between 0.1 μm to 0.4 μm. Each of the micro-crystal clusters 124 has an average number of the micro-crystals 125 stacked in a height direction thereof less than 15, preferably less than 13, more preferably less than 10, and most preferably less than 8. When the micro-crystals 125 are grouped together to form the micro-crystal cluster 124, they can be stacked into a tower structure or a branch structure extending outwardly so as to form a branch-shaped crystal group M.

There is no limitation on the arrangement among the micro-crystal clusters 124. The micro-crystal clusters 124 can be arranged in an irregular manner or be substantially arranged along the same direction. In addition, a number of the micro-crystal clusters 124 can be arranged into a row and a portion of the rows have the same extension direction.

The micro-rough surface 121 of the micro-roughened electrodeposited copper foil 12 has an average roughness Rz greater than 0.5 μm, preferably greater than 1.5 μm, and more preferably greater than 2 μm. When the average roughness Rz of the micro-rough surface 121 satisfies the above ranges, the micro-roughened electrodeposited copper foil 12 has good bonding strength relative to the substrate 11. That is to say, the increase of the average roughness Rz can improve the bonding strength between the micro-roughened electrodeposited copper foil 12 and the substrate 11, and thus to significantly increase the peel strength. For the copper foil substrate 1 provided with 1 oz copper foils, the peel strength between the micro-roughened electrodeposited copper foil 12 and the substrate 11 can be greater than 3 lb/in, preferably greater than 4.3 lb/in, more preferably greater than 4.5 lb/in, and most preferably greater than 4.7 lb/in. It is worth mentioning that, when an adhesive is applied to the micro-rough surface 11, the adhesive would permeate into the grooves 123 and the bottoms of the micro-crystal clusters 124, such that the peel strength of the micro-roughened electrodeposited copper foil 12 after adhering to the substrate 11 can be significantly increased.

By the profile of the micro-rough surface 121, the micro-roughened electrodeposited copper foil 12 can have enough peel strength relative to the substrate 11 and can significantly reduce the signal transmission loss. The micro-rough surface 121 has an Rlr value less than 1.3, preferably less than 1.26, and more preferably less than 1.23. The term "Rlr value" refers to an expanded length ratio, i.e., a length ratio of the surface profile of the test object per unit length. A higher Rlr value indicates that the surface profile is more uneven, and the surface is completely flat when the value is equal to 1. The Rlr value satisfies the equation of Rlr=Rlo/L; Rlo represents a measured profile length; L represents a measured distance. The Rlr value of the micro-roughened electrodeposited copper foil 12 is measured by a shape measurement laser microscope ("VK-X100" made by Keyence Corporation), and the cut-off wavelengths λs and λc for measurement are respectively 2.5 μm and 0.003 mm.

When the Rlr value of the micro-roughened electrodeposited copper foil 12 is less than 1.3, the copper foil substrate 1 (e.g., IT170GRA 1+RG311) would have a better insertion loss performance. The copper foil substrate 1 has an insertion loss between 0 and -0.65 dB/in at 8 GHz, preferably between 0 and -0.63 dB/in, more preferably between 0 and -0.60 dB/in, and most preferably between 0 and -0.57 dB/in. The copper foil substrate 1 has an insertion loss between 0 and -1.0 dB/in at 12.89 GHz, preferably between 0 and -0.97 dB/in, more preferably between 0 and -0.94 dB/in, and most preferably between 0 and -0.90 dB/in. The copper foil substrate 1 has an insertion loss between 0 and -1.2 dB/in at 16 GHz, preferably between 0 and -1.15 dB/in, and more preferably between 0 and -1.1 dB/in. The copper foil substrate 1 has an insertion loss between 0 and -1.5 dB/in at 20 GHz, preferably between 0 and -1.45 dB/in, more preferably between 0 and -1.4 dB/in, still more preferably between 0 and -1.36 dB/in, and most preferably between 0 and -1.34 dB/in. The copper foil substrate 1 has an insertion loss between 0 and -0.78 dB/in at 25 GHz, preferably between 0 and -0.77 dB/in, more preferably between 0 and -0.76 dB/in, and most preferably between 0 and -0.74 dB/in. The copper foil substrate 1 has an insertion loss between 0 and -0.935 dB/in at 30 GHz, preferably between 0 and -0.92 dB/in, more preferably between 0 and -0.90 dB/in, and most preferably between 0 and -0.88 dB/in. In this description, the insertion loss is represented by a negative value. The micro-roughened electrodeposited copper foil 12 of the present disclosure can significantly reduce the signal transmission loss at 4 GHz to 20 GHz.

[Manufacturing Method of Micro-Roughened Electrodeposited Copper Foil]

The micro-roughened electrodeposited copper foil 12 is obtained by immersing a raw foil in a copper-containing plating solution and subsequently conducting an electrolytic roughening treatment in a predetermined period of time. In certain embodiments of the present disclosure, a reverse treated copper foil (RTF) is used as a raw foil and subsequently a rough surface thereof is roughened. The electrolytic roughening treatment can be performed by any conventional apparatus such as a continuous-type or batch-type electrolyzing apparatus.

The copper-containing plating solution contains copper ions, an acid component and a metal additive. The source of copper ions may be exemplified by copper sulfate, copper nitrate, or the combination thereof. The acid component may be exemplified by sulfuric acid, nitric acid, or the combination thereof. The metal additive may be exemplified by cobalt, iron, zinc, or the combination thereof. In addition, the copper-containing plating solution can further contain any conventional additive such as gelatin, organic nitride, hydroxyethyl cellulose (HEC), polyethylene glycol (PEG), sodium 3-mercaptopropane sulphonate (MPS), Bis-(sodium sulfopropyl)-disulfide (SPS), or thiourea-containing compounds, but is not limited thereto.

The electrolytic roughening treatment can be performed twice with the same or different copper-containing plating solutions. In one embodiment of the present disclosure, two different copper-containing plating solutions (i.e., first and second copper-containing plating solutions) are alternately used for the electrolytic roughening treatments. The first copper-containing plating solution has a copper ion concentration between 10 g/L and 30 g/L, an acid concentration between 70 g/L, and 100 g/L, and a metal additive concentration between 150 mg/L and 300 mg/L. The metal additive concentration is preferably between 15 mg/L and 100 mg/L. The second copper-containing plating solution has a copper ion concentration between 70 g/L and 100 g/L, an acid concentration between 30 g/L and 60 g/L, and a metal additive concentration between 15 mg/L and 100 mg/L.

The power required for the electrolytic roughening treatment can be supplied via a constant voltage, constant current, pulse wave, or saw wave manner, but is not limited thereto. In one embodiment of the present disclosure, for the electrolytic roughening treatments, the first copper-containing plating solution is used at a constant current density between 25 $A/dm^2$ and 40 $A/dm^2$ and subsequently the second copper-containing plating solution is used at a constant current density between 20 $A/dm^2$ and 30 $A/dm^2$. Preferably, the first copper-containing plating solution is used at a constant current density between 30 $A/dm^2$ and 56 $A/dm^2$ and the second copper-containing plating solution is used at a constant current density between 23 $A/dm^2$ and 26 $A/dm^2$. It is worth mentioning that, said constant current densities can be applied with a pulse or saw wave. In addition, if the power for the electrolytic roughening treatment is supplied with different constant voltages, each of the constant voltages must cause the current density to fall within the above current density ranges in the corresponding electrolytic roughening treatment.

When the electrolytic roughening treatment is performed thrice or more, the first and second copper-containing plating solutions can be alternately used for the electrolytic roughening treatments at a current density between 1 $A/dm^2$ and 60 $A/dm^2$. In one embodiment of the present disclosure, the first copper-containing plating solution and the second copper-containing plating solution are respectively used for the third and fourth electrolytic roughening treatments at a current density between 1 $A/dm^2$ and 8 $A/dm^2$ and a current density between 40 $A/dm^2$ and 60 $A/dm^2$. The fifth and later electrolytic roughening treatments are performed at a current density less than 5 $A/dm^2$. It is worth mentioning that, said constant current densities can be applied with a pulse or saw wave. In addition, if the power for the electrolytic roughening treatment is supplied with different constant voltages, each of the constant voltages must cause the current density to fall within the above current density ranges in the corresponding electrolytic roughening treatment.

It is worth mentioning that, the arrangement of the micro-crystal clusters 124 of the micro-rough surface 121 and the extension direction of the grooves 123 can be controlled by a flow field of the copper-containing plating solution(s). When no flow field or a turbulent flow is generated, the micro-crystal clusters 124 are arranged in an irregular manner. When the flow field is generated on the surface of the copper foil along a predetermined direction, the structures formed would be substantially arranged along the same direction. However, the control manner of the arrangement of the micro-crystal clusters 124 and the extension direction of the grooves 123 are not limited to such details. In addition, it is also possible to use a steel brush to pre-scratch the non-oriented grooves 123 or be adjusted to use any other conventional techniques as deemed fit by the manufacturer.

In one embodiment of the present disclosure, a continuous-type electrolyzing apparatus, which includes a plurality of tanks and a plurality of electrolyzing rolls, can be used to perform the electrolytic roughening treatment(s). The first copper-containing plating solution and the second copper-containing plating solution are alternately accommodated in the tanks. The electrolysis power is supplied with constant voltage(s). The production speed is controlled at 5-20 m/min and the production temperature is controlled at 20-60° C.

It should be noted that, the above method for manufacturing the micro-roughened electrodeposited copper foil can be applied to the high-temperature-elongation (HTE) copper foil or very low profile (VLP) copper foil.

The structure and the manufacturing method of each layer of the copper foil substrate 1 are described above. The following will provide Examples 1-3 and comparisons among Examples 1-3 and Comparative Examples 1-4, and further describe the advantages of the present disclosure.

Example 1

Figure 3:
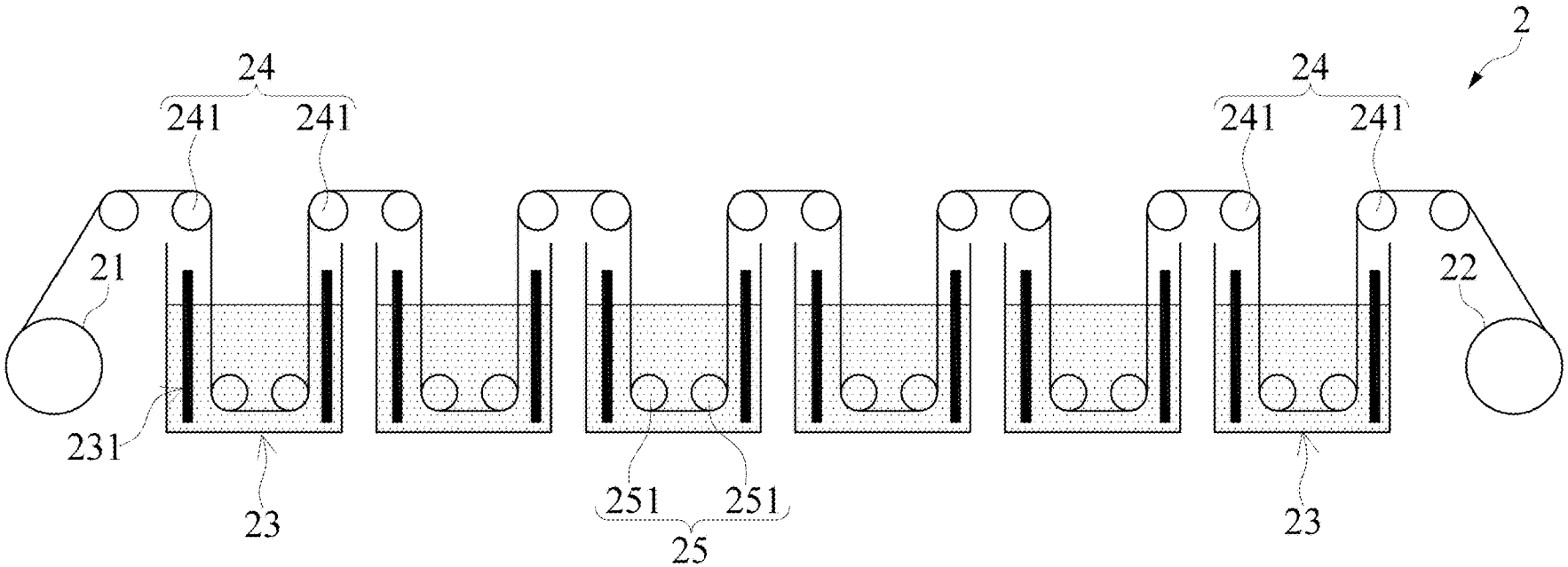
FIG. 3 is a schematic view showing a production apparatus of a micro-roughened electrolysis copper foil.

Referring to FIG. 3, a continuous-type electrolyzing apparatus 2, which can be used to perform electrolytic roughening treatment(s), is shown. The continuous-type electrolyzing apparatus 2 includes a feeding roll 21, a receiving roll 22, six tanks 23 (i.e., first to sixth tanks) arranged between the feeding roll 21 and the receiving roll 22, six electrolyzing roll assemblies 24 respectively arranged above the tanks 23, and six auxiliary roll assemblies 25 respectively arranged in the tanks 23. Each of the tanks 23 has a pair of platinum electrodes 231 arranged therein. Each of the electrolyzing roll assemblies 24 includes two electrolyzing rolls 241. Each of the auxiliary roll assemblies 25 includes two auxiliary rolls 251. The pair of platinum electrodes 231 in each of the tanks 23 and the corresponding electrolyzing roll assembly 24 are electrically connected to an anode and a cathode of an outer power supply, respectively.

In this example, a reverse treated copper foil (RTF) (product name "RG311", purchased from Co-Tech Copper Foil Company) is used as a raw foil. The raw foil is rolled up on the feeding roll 21 and pulled tightly around the electrolyzing roll assemblies 24 and the auxiliary roll assemblies 25 in order, and is subsequently rolled up on the receiving roll 22. The copper-containing plating solutions in each of the tanks are shown in Table 1, wherein the source of copper ions is copper sulfate. The raw foil sequentially passes through the first to sixth tanks 23 at a production speed of 10 m/min to roughen a matte side thereof. Accordingly, micro-roughened electrolysis copper foils each having a surface roughness Rz, which is in compliance with the JIS B0601-1994 standard, of 1.29 are obtained. Finally, two of the micro-roughened electrolysis copper foils are attached to an IT170GRA1 substrate, so as to form a copper foil substrate.

Figure 4:
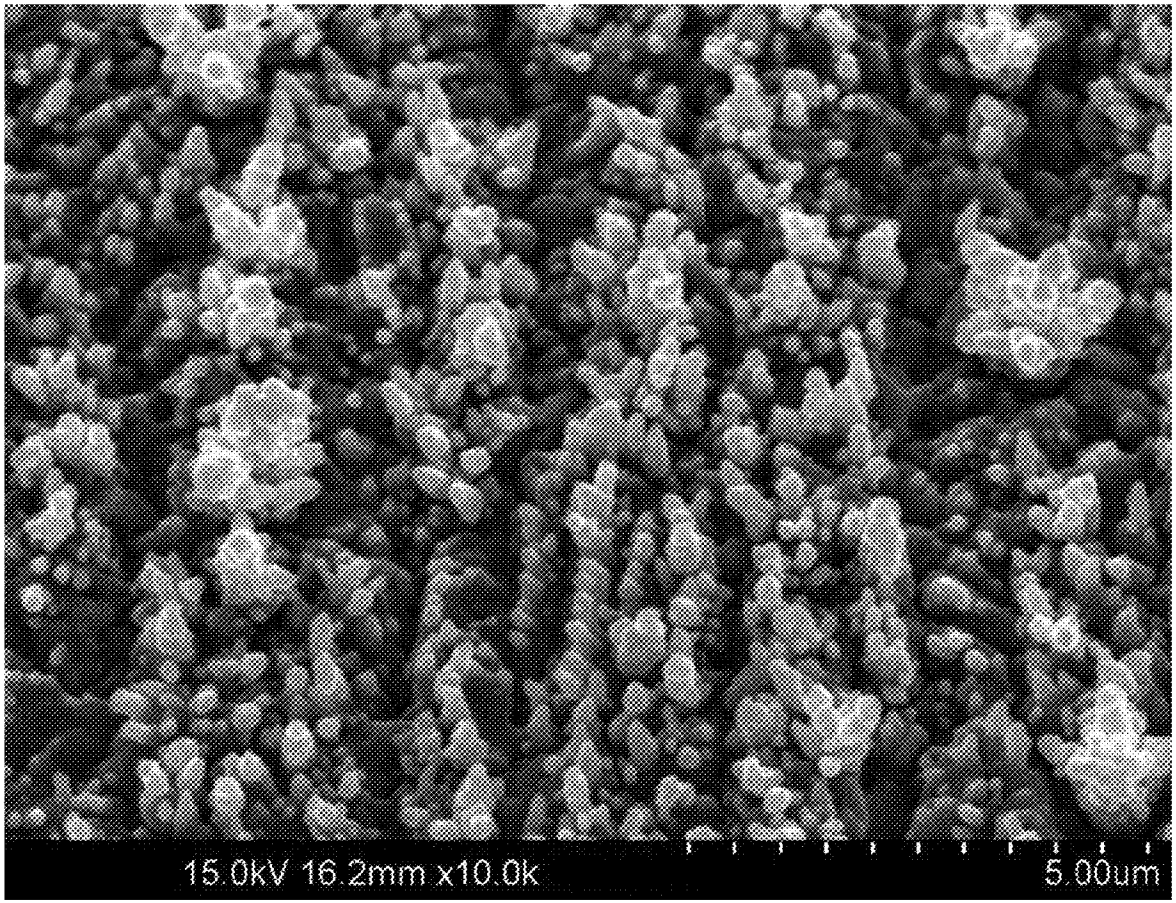
FIG. 4 is a scanning electron microscope image showing a surface profile of the micro-roughened electrolysis copper foil of Example 1.
Figure 5:
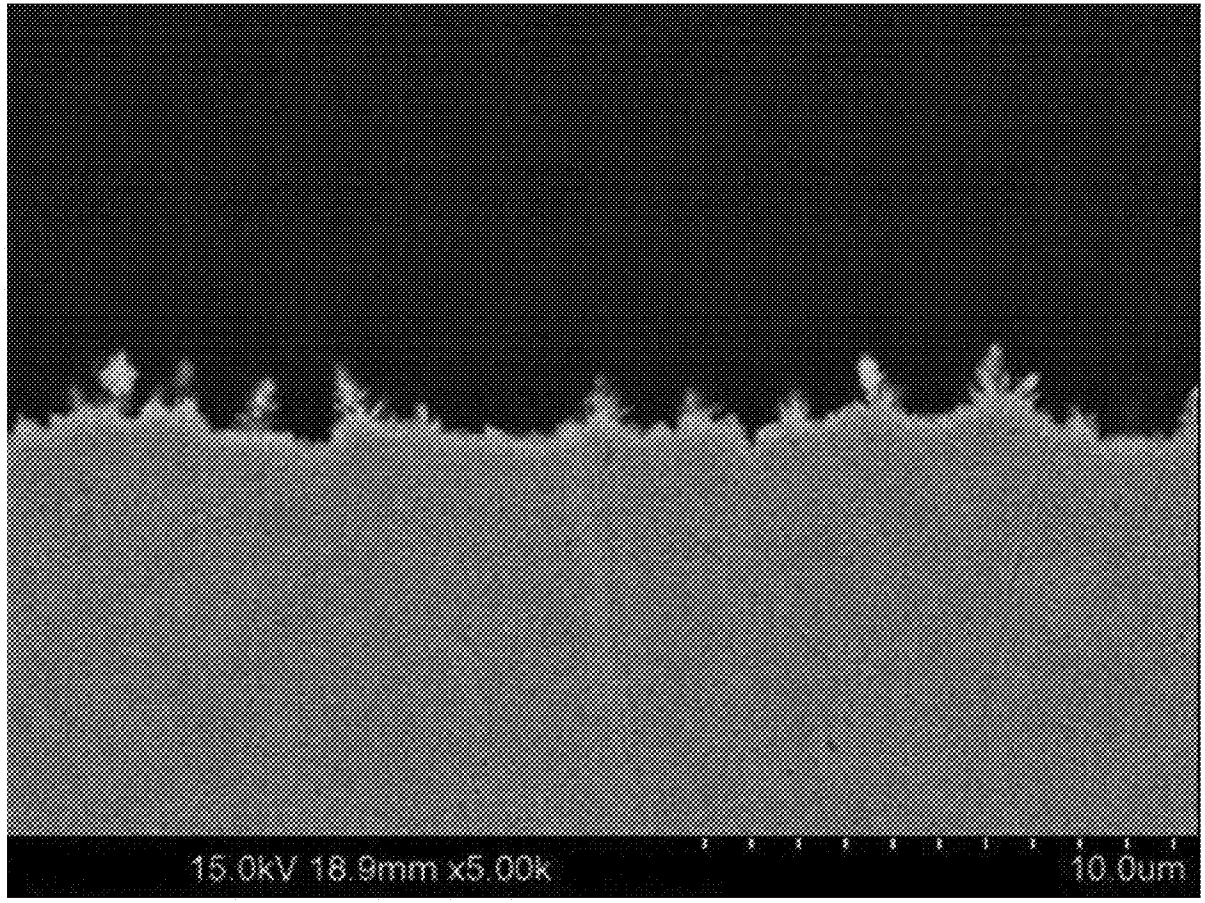
FIG. 5 is a scanning electron microscope image showing a cross-section profile of the micro-roughened electrolysis copper foil of Example 1.

The surface and the cross-sectional structures of the micro-roughened electrolysis copper foil of Example 1 observed by a scanning electron microscope are shown in FIG. 4 and FIG. 5 respectively.

The micro-roughened electrolysis copper foil of Example 1, in which the micro-rough surface is coated with a silane coupling agent, is adhered to the IT170GRA1 substrate. After curing the IPC-TM-650 2.4.8 test method is used for peel strength measurement. The result is shown in Table 2.

The Rlr value of the micro-roughened electrolysis copper foil of Example 1 is measured by a shape measurement laser microscope ("VK-X100" made by Keyence Corporation). The result is shown in Table 2.

The insertion loss of the micro-roughened electrolysis copper foil of Example 1 is measured by a microstrip line having a characteristic impedance 50 ohms at 4 GHz, 8 GHz, 12.89 GHz, 16 GHz and 20 GHz. The results are shown in Table 2.

Examples 2 and 3

The raw foil, the electrolyzing apparatus and the composition of the copper-containing plating solution are the same as in Example 1. The electroplating conditions are shown in Table 1 and the production speed is 10 m/min. Two of the micro-roughened electrolysis copper foils of Example 2 and 3 are attached to an IT170GRA1 substrate. The copper foil substrates obtained are measured in the same ways as in Example 1, and the results are shown in Table 2.

Comparative Examples 1 and 2

The raw foil, the electrolyzing apparatus and the composition of the copper-containing plating solution are the same as in Example 1. The electroplating conditions are shown in Table 1 and the production speed is 10 m/min. Two of the micro-roughened electrolysis copper foils of Comparative Examples 1 and 2 are attached to an IT170GRA1 substrate. The copper foil substrates obtained are measured in the same ways as in Example 1, and the results are shown in Table 2.

Comparative Example 3

Figure 6:
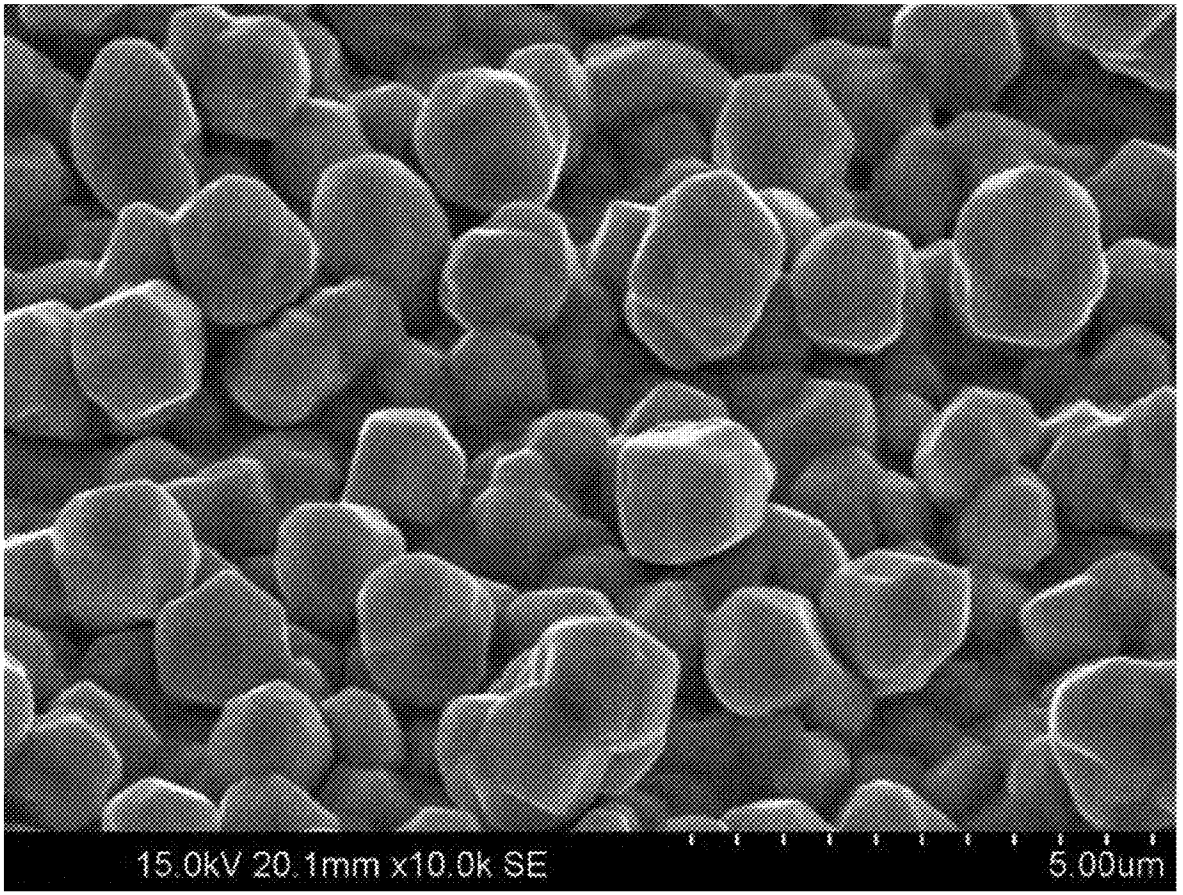
FIG. 6 is a scanning electron microscope image showing a surface profile of a copper foil of Comparative Example 3.
Figure 7:
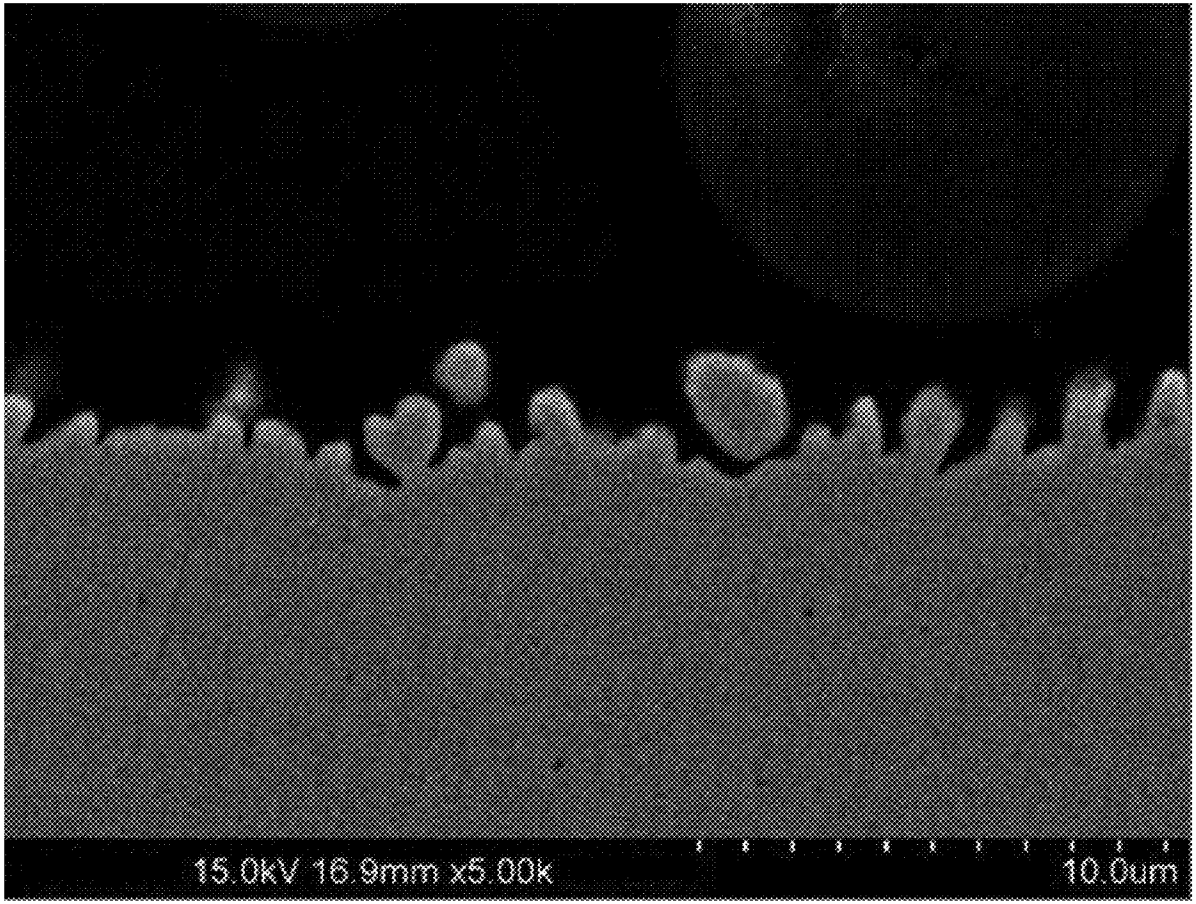
FIG. 7 is a scanning electron microscope image showing a cross-section profile of the copper foil of Comparative Example 3.

Comparative Example 3 uses reverse treated copper foils (product name "MLS-G", from Mitsui Mining & Smelting Co., Ltd., hereinafter "MLS-G copper foil"). The surface and the cross-sectional structures of the MLS-G copper foil are observed by a scanning electron microscope, which are shown in FIG. 6 and FIG. 7 respectively. Two of the MLS-G copper foils are attached to an IT170GRA1 substrate so as to obtain a copper foil substrate, the peel strength, Rlr value and insertion loss of which are measured in the same ways as in Example 1, and the results are shown in Table 2.

Comparative Example 4

Comparative Example 4 uses reverse treated copper foils (product name "RTF3", from Chang Chun Petrochemical Co., Ltd, hereinafter "RTF3 copper foil"). The surface and the cross-sectional structures of the HS1-M2-VSP copper foil are observed by a scanning electron microscope, which are shown in FIG. 8 and FIG. 9 respectively. Two of the RTF3 copper foils are attached to an IT170GRA1 substrate so as to obtain a copper foil substrate, the peel strength, Rlr value and insertion loss of which are measured in the same ways as in Example 1, and the results are shown in Table 2.

TABLE 1

| | First tank | Second tank | Third tank | Fourth tank | Fifth tank | Sixth tank |
|---|---|---|---|---|---|---|
| $Cu^{+2}$ (g/L) | 15.5~20.5 | 86.5~90.5 | 15.5~20.5 | 86.5~90.5 | 15.5~20.5 | 86.5~90.5 |
| Cl (ppm) | <3 | <3 | <3 | <3 | <3 | <3 |
| $H_2SO_4$ (g/L) | 15.5-20.5 | 86.5-90.5 | 15.5-20.5 | 86.5-90.5 | 15.5-20.5 | 86.5-90.5 |
| Metal additive (ppm) | <3 | <3 | <3 | <3 | <3 | <3 |
| Example 1 (A/dm$^2$) | 83-87 | 45-55 | 83-87 | 45-55 | 83-87 | 45-55 |
| Example 2 (A/dm$^2$) | 180-220 | 30-40 | 180-220 | 30-40 | 180-220 | 30-40 |
| Example 3 (A/dm$^2$) | 30.56 | 24.60 | 48.15 | 4.63 | 1.05 | 4.92 |
| Comparative Example 1 (A/dm$^2$) | 33.34 | 24.60 | 48.15 | 4.63 | 1.05 | 4.92 |
| Comparative Example 2 (A/dm$^2$) | 36.11 | 24.60 | 48.15 | 4.63 | 1.05 | 4.92 |

TABLE 2

| | | Examples | | | Comparative Examples | | | |
|---|---|---|---|---|---|---|---|---|
| | | 1 | 2 | 3 | 1 | 2 | 3 (MLS-G) | 4 (RTF3) |
| Peel strength (lb/in) | | 4.75 | 4.87 | 5.09 | 5.12 | 5.50 | 5.02 | 5.10 |
| Rlr | | 1.156 | 1.205 | 1.257 | 1.343 | 1.508 | 1.334 | 1.605 |
| Insertion loss (dB/in) | −0.308 | −0.317 | −0.337 | −0.352 | −0.401 | −0.344 | −0.518 | −0.190 |
| | −0.565 | −0.586 | −0.614 | −0.657 | −0.738 | −0.653 | −0.848 | −0.311 |
| | −0.884 | −0.912 | −0.960 | −1.023 | −1.149 | −1.011 | −1.248 | −0.454 |
| | −1.077 | −1.114 | −1.171 | −1.250 | −1.406 | −1.234 | −1.493 | −0.561 |
| | −1.329 | −1.373 | −1.447 | −1.537 | −1.736 | −1.507 | −1.805 | −0.696 |

As shown in FIG. 4 and FIG. 5, the micro-rough surface of Example 1 has a plurality of grooves that extend along an up-down direction and substantially along the same direction. Each of the grooves has a width between the 0.4 μm and 4 μm and a depth less than or equal to 0.8 μm. The peaks among the grooves are formed with clear micro-crystal clusters. Each of the micro-crystal clusters has a height less than or equal to 2 μm, and is composed of a plurality of micro-crystals each having a particle diameter between 0.1 μm and 0.4 μm grouped together.

As shown in FIG. 6 and FIG. 7, the surface of the MLS-G copper foil is uniformly covered by a plurality of micro-crystals each having a particle diameter greater 3 μm; and a few of the micro-crystals aggregate with each other. It can be observed from the cross-sectional view that the micro-crystals are spaced apart from each other and do not aggregate at certain locations.

As shown in Table 2, with respect to the peel strength performance, the peel strengths of the copper foil substrates of Examples 1 to 3 are at least 4.75 lb/in that exceeds the industry standard of 4 lb/in by at least 18%. It can be observed that the micro-roughened electrolysis copper foil of the present disclosure has good bonding strength relative to the substrate and facilitates the performing of subsequent processes while maintaining product yield.

With respect to the insertion loss performance, the insertion losses of the copper foil substrates of Examples 1 to 3 at 8 GHz to 20 GHz are better than the insertion losses of the copper foil substrates of Comparative Examples 1 to 4. It is worth mentioning that, signal losses at high frequencies can be significantly reduced by controlling the surface profile of the micro-rough surface and adjusting the Rlr value to less than 1.3. In addition, it can be found that as the Rlr value gets lower, the signal losses are correspondingly reduced.

It is evident from the above description that the micro-roughened electrolysis copper foil can further optimize the insertion loss performance to significantly reduce the signal losses while maintaining good peel strength.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A micro-roughened electrodeposited copper foil comprising a micro-rough surface that has a plurality of peaks, a plurality of grooves and a plurality of micro-crystal clusters, wherein each of the grooves has a U-shaped or V-shaped cross-section profile, and the grooves have an average maximum width between 0.1 μm and 4 μm and an average depth less than or equal to 1.5 μm, and the micro-crystal clusters are correspondingly located on the tops of the peaks and are each composed of a plurality of micro-crystals each having an average diameter less than or equal to 0.5 μm grouped together;

wherein the micro-rough surface of the micro-roughened electrodeposited copper foil has an Rlr value less than 1.3, and the Rlr value satisfies the equation of Rlr=Rlo/L, where Rlo represents a measured profile length and L represents a measured distance.

2. The micro-roughened electrodeposited copper foil according to claim 1, wherein each of the micro-crystals has an average height less than or equal to 2 μm.

3. The micro-roughened electrodeposited copper foil according to claim 2, wherein each of the micro-crystal clusters has an average number of the micro-crystals being less than 15 that are stacked in a height direction of the micro-crystal clusters, and the average maximum width of the micro-crystal clusters is less than or equal to 5 μm, and a number of the micro-crystal clusters form into a branch-shaped crystal group.

4. The micro-roughened electrodeposited copper foil according to claim 1, wherein the Rlr value the micro-rough surface of the micro-roughened electrodeposited copper foil is less than 1.26.

5. The micro-roughened electrodeposited copper foil according to claim 2, wherein the Rlr value of the micro-rough surface of the micro-roughened electrodeposited copper foil is less than 1.26.

6. The micro-roughened electrodeposited copper foil according to claim 3, wherein the Rlr value of the micro-rough surface of the micro-roughened electrodeposited copper foil is less than 1.26.

7. A copper foil substrate, comprising:

a substrate; and a micro-roughened electrodeposited copper foil including a micro-rough surface attached to the substrate, the micro-rough surface having a plurality of peaks, a plurality of grooves and a plurality of micro-crystal clusters, wherein each of the grooves has a U-shaped or V-shaped cross-section profile, and the grooves have an average maximum width between 0.1 μm and 4 μm and an average depth less than or equal to 1.5 μm, and the micro-crystal clusters are correspondingly located on the tops of the peaks and each has an average height less than or equal to 2 μm;

wherein the copper foil substrate has an insertion loss between 0 and -1.5 dB/in at 20 GHz;

wherein the micro-roughened electrodeposited copper foil has a peel strength greater than 4.3 lb/in relative to the substrate.

8. The copper foil substrate according to claim 7, wherein the copper foil substrate has an insertion loss between 0 and -1.2 dB/in at 16 GHz.

9. The copper foil substrate according to claim 8, wherein the copper foil substrate has an insertion loss between 0 and -0.65 dB/in at 8 GHz and an insertion loss between 0 and -1.0 dB/in at 12.89 GHz.

10. The copper foil substrate according to claim 9, wherein the insertion loss of the copper foil substrate at 8 GHz is between 0 and -0.63 dB/in, the insertion loss of the copper foil substrate at 12.89 GHz is between 0 and -0.97 dB/in, the insertion loss of the copper foil substrate at 16 GHz is between 0 and -1.15 dB/in, and the insertion loss of the copper foil substrate at 20 GHz is between 0 and -1.45 dB/in.

11. The copper foil substrate according to claim 7, wherein the average maximum width of the micro-crystal clusters is less than or equal to 5 μm, a number of the micro-crystal clusters form into a branch-shaped crystal group, and each of the micro-crystal clusters is composed of a plurality of micro-crystals grouped together and having an average height of less than or equal to 1.8 μm, and wherein the micro-rough surface of the micro-roughened electrodeposited copper foil has an Rlr value less than 1.26, and the Rlr value satisfies the equation of Rlr=Rlo/L, where Rlo represents a measured profile length and L represents a measured distance.

12. The copper foil substrate according to claim 7, wherein the substrate has a dielectric constant (Dk) less than 4.0 and a dissipation factor (Df) less than 0.015 at 10 GHz.

* * * * *